US005521679A

United States Patent [19]

Miyakawa et al.

[11] Patent Number: 5,521,679

[45] Date of Patent: May 28, 1996

[54] IMAGE FORMING APPARATUS HAVING CLAMP FOR CONVEYING A RECORDING MEDIUM

[75] Inventors: Seiichi Miyakawa, Nagareyama; Shigeru Suzuki, Yokohama; Kazuaki Iizuka, Tokyo; Yoshiyumi Tamiya, Yokohama; Kenichi Shimizu, Kawasaki; Harumitsu Mashiko, Tokyo; Takashi Seto, Ayase; Eishu Ohdake, Tokyo; Tadahiro Suzuki, Kawasaki, all of Japan

[73] Assignee: Ricoh Company, Ltd., Tokyo, Japan

[21] Appl. No.: 153,968

[22] Filed: Nov. 18, 1993

[30] Foreign Application Priority Data

Nov. 20, 1992 [JP] Japan ..... 4-335492

[51] Int. Cl.[6] ..... G03G 15/05; G03G 15/18

[52] U.S. Cl. ..... 355/217; 355/271; 355/273

[58] Field of Search ..... 355/271, 272, 355/273, 274, 275, 277, 217, 210, 27

[56] References Cited

U.S. PATENT DOCUMENTS

| | | | |
|---|---|---|---|
| 3,645,614 | 2/1972 | McFarlane, Jr. et al. | 355/217 X |
| 3,945,725 | 3/1976 | Moriyama et al. | 355/217 X |
| 3,964,827 | 6/1976 | Tanaka et al. | 355/272 |
| 4,403,849 | 9/1983 | Burger et al. | 355/217 X |
| 4,552,448 | 11/1985 | Davidson | 355/271 X |
| 5,038,178 | 8/1991 | Hosoya et al. | 355/277 |
| 5,053,826 | 10/1991 | Castelli et al. | 355/271 |
| 5,130,758 | 7/1992 | Takeda et al. | 355/271 |
| 5,136,336 | 8/1992 | Dastin et al. | 355/274 |
| 5,150,163 | 9/1992 | Durland et al. | 355/271 |
| 5,172,165 | 12/1992 | Hatakeyama et al. | 355/215 |
| 5,250,994 | 10/1993 | Ito et al. | 355/271 |
| 5,416,565 | 5/1995 | Noda | 355/277 X |

*Primary Examiner*—Sandra L. Brase

*Attorney, Agent, or Firm*—Oblon, Spivak, McClelland, Maier & Neustadt

[57] ABSTRACT

An image forming apparatus for electrostatically transferring a latent image formed on a photoconductive drum or similar image carrier to a recording medium held by a clamp drum or similar medium conveying member. The clamp drum has a cylinder or base made of aluminum, a conductive rubber layer covering the cylinder, and an overcoat layer covering the rubber layer and higher in electric resistance than the rubber layer. A bias voltage for latent image transfer is applied while the rubber layer is connected to ground. The photoconductive drum and clamp drum are pressed against each other by a predetermined force, the former following the rotation of the latter. The photoconductive drum is provided with a photoconductor having a great electrostatic capacity, thereby preventing the effective transfer voltage at the time of image transfer from increasing.

5 Claims, 6 Drawing Sheets

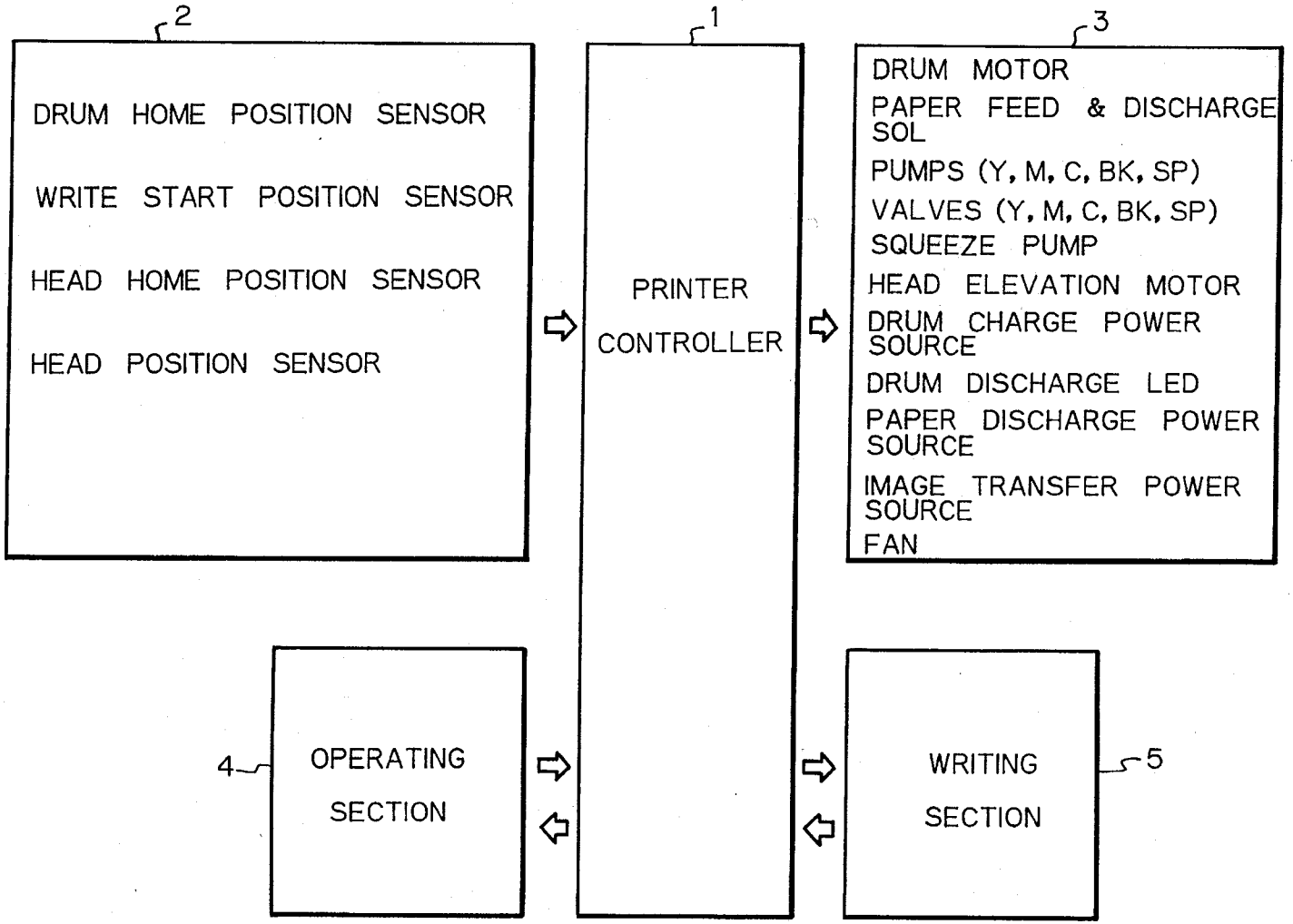
Fig. 6
1
PRINTER CONTROLLER
2
DRUM HOME POSITION SENSOR
WRITE START POSITION SENSOR
HEAD HOME POSITION SENSOR
HEAD POSITION SENSOR
3
DRUM MOTOR
PAPER FEED & DISCHARGE SOL
PUMPS (Y, M, C, BK, SP)
VALVES (Y, M, C, BK, SP)
SQUEEZE PUMP
HEAD ELEVATION MOTOR
DRUM CHARGE POWER SOURCE
DRUM DISCHARGE LED
PAPER DISCHARGE POWER SOURCE
IMAGE TRANSFER POWER SOURCE
FAN
4
OPERATING SECTION
5
WRITING SECTION

IMAGE FORMING APPARATUS HAVING CLAMP FOR CONVEYING A RECORDING MEDIUM

BACKGROUND OF THE INVENTION

The present invention relates to a copier, facsimile apparatus, printer or similar image forming apparatus and, more particularly, to an image forming apparatus of the type electrostatically transferring a latent image formed on a photoconductive drum or similar image carrier to a recording medium held by a clamp drum or similar medium conveying member.

Conventional image forming apparatuses included one which forms a latent image on a charged image carrier, electrostatically transfers the latent image to a recording medium retained by a clamp drum or similar medium conveying member, and then develops the latent image by a developing device. In this type of apparatus, when the image carrier is implemented by, for example, an organic photoconductor (OPC) extensively used in electrophotographic copiers, it is charged to a potential higher than −600 V. An exposing device exposes the charged surface of the image carrier imagewise so as to form a latent image thereon. When the image carrier is discharged and charged during the course of image formation, it is connected to ground since a predetermined voltage is applied thereto from an external power source. On the other hand, when the latent image is electrostatically transferred from the image carrier to a recording medium held by the medium conveying member, it is necessary to transfer the potential of the image carrier to the medium efficiently. For this purpose, the surface of the image carrier and the medium are brought into close contact, and a bias voltage is applied from an external power source. In the case of positive-to-positive image formation, the bias voltage is selected to be higher than about 400 V. While the bias voltage is applied, gaseous discharge is effected to transfer the latent image from the image carrier to the medium. In the event of such image transfer, the image carrier is held in close contact with the medium and driven at the same peripheral speed as the medium conveying member retaining the medium thereon. To drive the image carrier, the rotation of the conveying member may be transmitted to the image carrier by gears, or an exclusive drive source may be assigned to the image carrier.

However, the conventional image forming apparatus of the type described has various problems left unsolved, as enumerated below.

(1) When the medium and/or the image carrier has local defects, e.g., defective voltage resistivity, the voltage left for image transfer is lowered. As a result, defective image transfer extends to the entire area, not to speak of the local defects.

(2) The medium conveying member includes a conductive portion which contacts the rear (non-recording surface) of the medium for conduction with the electrode layer of the medium. When the image carrier is connected to ground, a transfer bias is usually applied to the conductive portion in order to electrically insulate the medium conveying member from the apparatus body. Hence, it is necessary to electrically insulate the medium conveying member from the apparatus body or to connect the conveying member to a drive line via an insulating material. However, an insulating material is difficult to machine with accuracy and is susceptible to wear and changes in temperature and humidity, obstructing precision drive, indispensable for high definition images. Particularly, when the medium conveying member is implemented as a drum, the drum should be provided with a diameter matching the size of the medium and, therefore, a relatively large diameter. This kind of medium conveying member magnifies even unnoticeable changes around the axis of rotation thereof, impairing the register of images.

(3) When the image carrier is driven, via gears, as stated previously, gear marks appear due to back lash and other similar causes. This is particularly true in the case of high density image writing. Further, the distance between the gear of the image carrier and that of the drive line unavoidably changes, so that the pitch circle of the gears cannot be maintained constant. As a result, the image carrier and the conveying member move at different speeds at their contacting portion. On the other hand, when an exclusive drive source is assigned to the medium conveying member, small differences in speed between the image carrier and the conveying means are sequentially accumulated as the medium is transported, resulting in a noticeable dislocation of an image. This problem is especially serious when the medium has a substantial length.

(4) In the conventional electrostatic image transfer, the effective transfer voltage is undesirably high. Here, the term "effective transfer voltage" refers to a gap voltage calculated on the assumption that the electrostatic capacity of the gap between the surface of the image carrier and the recording surface of the medium is infinite. Therefore, regarding the calculation of a potential distribution, the electrostatic capacities of the image carrier and medium are assumed to be negligible. The substantial effective transfer voltage is produced by adding the charge potentials of the medium and image carrier before image transfer and the bias voltage for image transfer, taking account of polarity and grounding portion. The charge potential of the image carrier is the potential measured on the surface by using the base of the image carrier as a reference. In the conventional arrangement, the charge potential of the image carrier is higher than 600 V, the bias voltage for image transfer is 400 V, and the charge potential of the medium is 0 V. The sum of these voltages, i.e., the effective transfer voltage is higher than 1000 V. When a latent image is transferred by such a high effective transfer voltage, white dots ascribable to abnormal discharge appear in a solid image.

SUMMARY OF THE INVENTION

It is, therefore, an object of the present invention to provide an image forming apparatus capable of forming high definition hard-dot images free from irregular density distributions.

It is another object of the present invention to provide an image forming apparatus insuring high image quality by eliminating the displacement of images due to, for example, the irregular rotation of an image carrier.

It is another object of the present invention to provide an image forming apparatus capable of producing attractive images free from defects ascribable to abnormal discharge.

In accordance with the present invention, an image forming apparatus comprises an image carrier for forming a latent image on the surface thereof, and a medium conveying member for releasably clamping and conveying a recording medium in order to transfer the latent image from the image carrier to the recording medium electrostatically. The medium conveying member comprises a base, a first layer covering the base and formed of an elastic substance having a low electric resistance, and at least one second layer covering the first layer and formed of a substance higher in electric resistance than the first layer.

Also, in accordance with the present invention, an image forming apparatus comprises an image carrier for forming a latent image on the surface thereof, and a medium conveying member for releasably clamping and conveying a recording medium in order to transfer the latent image from the image carrier to the recording medium electrostatically. The medium conveying member comprises a base, a first layer covering the base and formed of an elastic substance having a low electric resistance, and at least one second layer covering the first layer and formed of a substance higher in electric resistance than the first layer. The image carrier and medium conveying member are pressed against each other by a predetermined force, whereby a drive force is transferred from the medium conveying member to the image carrier.

Further, in accordance with the present invention, an image forming apparatus comprises an image carrier for forming a latent image on the surface thereof, a medium conveying member for releasably clamping and conveying a recording medium, and a bias voltage applying device for applying, when the latent image is to be transferred from the image carrier to the recording medium electrostatically, a bias voltage to between the image carrier and the medium conveying member. An effective transfer voltage produced by adding, in consideration of polarity and grounding portion, the charge potential of the recording medium before image transfer, the charge potential of the image carrier before image transfer, and the bias voltage to be applied at the time of image transfer is lower than 800 V at the time of image transfer.

BRIEF DESCRIPTION OF THE DRAWINGS

The above and other objects, features and advantages of the present invention will become more apparent from the following detailed description taken with the accompanying drawings in which:

FIG. 6 is a block diagram schematically showing a control system incorporated in the embodiment.

DESCRIPTION OF THE PREFERRED EMBODIMENT

Figure 1:
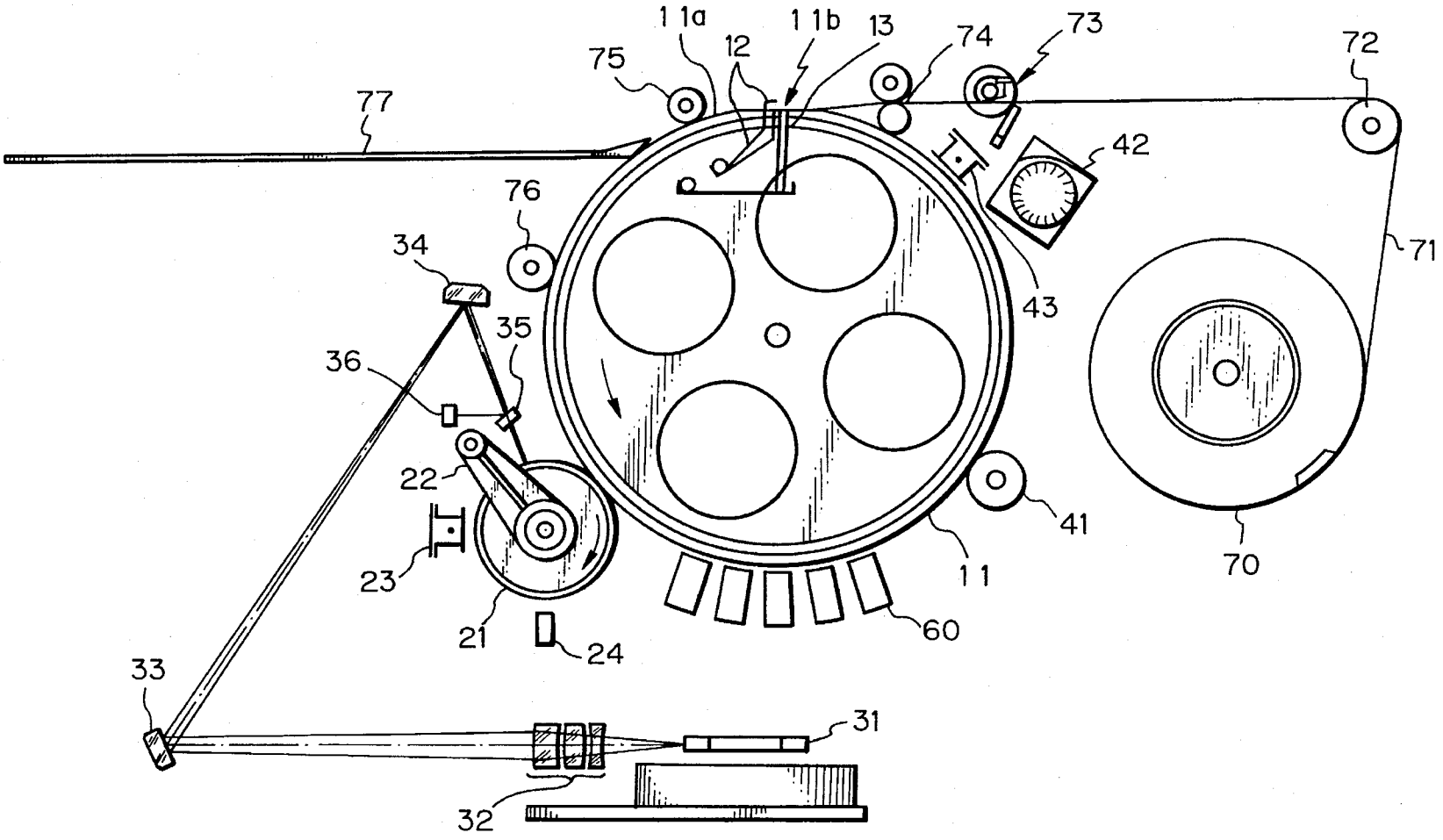
FIG. 1 is a section of an image forming apparatus embodying the present invention and implemented as a color printer.

Referring to FIG. 1 of the drawings, an image forming apparatus embodying the present invention is shown and implemented as a color printer by way of example. As shown, the color printer has a paper roll 70 supported by a holder, not shown. A paper 71 is paid out from the roll 70 with the recording surface thereof facing outward. A clamp drum, or medium conveying member, has a flat portion 11*b* in a part thereof. A clamp 12 and an eject pin 13 are provided on the flat portion 11*b* of the drum 11. The clamp 12 plays the role of a paper holding member for gripping the leading edge of the paper 71. The eject pin 13 causes the paper 71 to rise when the paper 71 should be discharged. The clamp 12 and eject pin 13 are each mounted on respective rotary shafts disposed in the drum 11 and extending out from the end of the drum 11. A cam-like lever, not shown, is affixed to the end of each rotary shaft protruding from a flange, not shown, included in the drum 11. Pins, not shown, are studded on the side panel of the printer and movable in the axial direction of the drum 11 such that they selectively contact the associated cam-like levers.

To wrap the paper 71 around the drum 11, the drum 11 is once brought to a stop when the flat portion 11*b* thereof reaches a paper feed position (substantially the top). At this instant, the clamp 12 remains in an open position. The paper 71 is paid out until the leading edge thereof has been inserted into the nip portion of a feed roller pair 74 via a guide roller 72 and a cutter 73. A paper sensor, not shown, senses the leading edge of the paper 71. The paper 71 is continuously fed until the leading edge thereof slightly buckles in abutment against the clamp 12. Subsequently, when the drum 11 is rotated in a direction indicated by an arrow in the figure, the cam-like lever of the clamp 12 is released from the associated pin of the printer side panel with the result that the clamp 12 is closed to grip the paper 71. As the drum 11 is further rotated in the same direction, the paper 71 is wrapped around the drum 11. When the drum 11 reaches a an angular position where the paper 71 has been wrapped around over a predetermined length, the rotation of the drum 11 is once stopped. Then, the cutter 73 is operated to cut the paper 71 from the roll 70.

Arranged around the drum 11 is an image carrier in the form of a photoconductive drum 21, a device for exposing the drum 21 imagewise, a device for developing an electrostatic latent image transferred to the paper 71, etc. The exposing device includes a laser diode, not shown, a polygon mirror 31, a mirror motor, not shown, for driving the mirror 31, a beam expander, not shown, lenses 32 including an f-theta lens and a cylindrical lens, a first mirror 33, a second mirror 34, a mirror 35 for detecting synchronization, and a sensor 35 responsive to synchronization. A laser beam issuing from the laser diode is reflected by the polygon mirror 31, restricted by the lenses 32, reflected by the mirrors 33 and 34, and then incident to the drum 21. As a result, the laser beam electrostatically forms a latent image on the drum 21. The optical path extending from the laser diode to the drum 21 has a particular length which provides the beam spot restricted by the lenses 32 with the minimum diameter. In the illustrative embodiment, the laser diode, polygon mirror 31, lenses 32 and so forth are mounted on a common base. This base is movable in the right-and-left direction, as viewed in FIG. 1, so as to adjust the length of the above-mentioned optical path.

Figure 4:
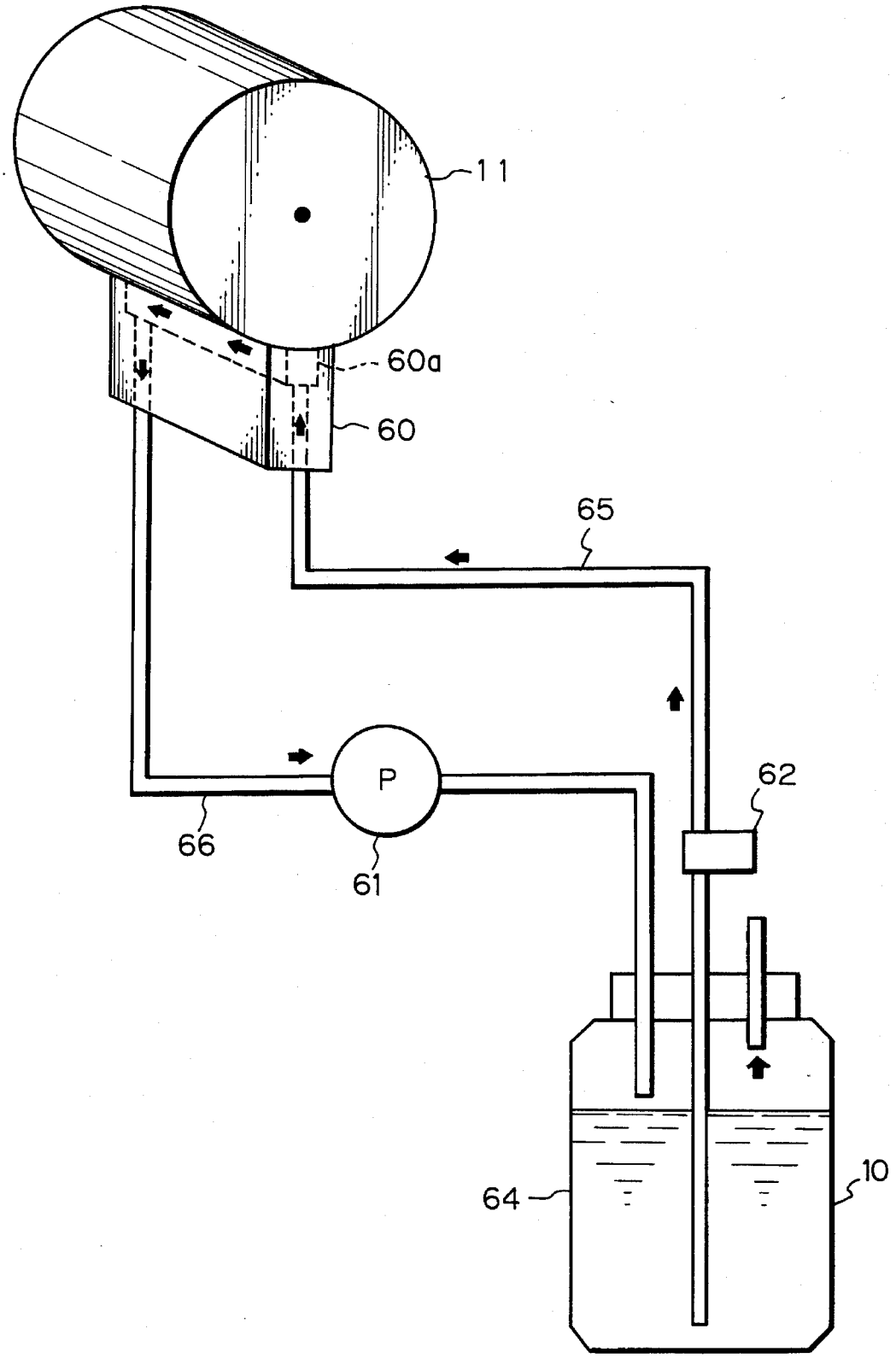
FIG. 4 shows a conduit work included in the embodiment for circulating a developing liquid through a developing device.
Figure 5:
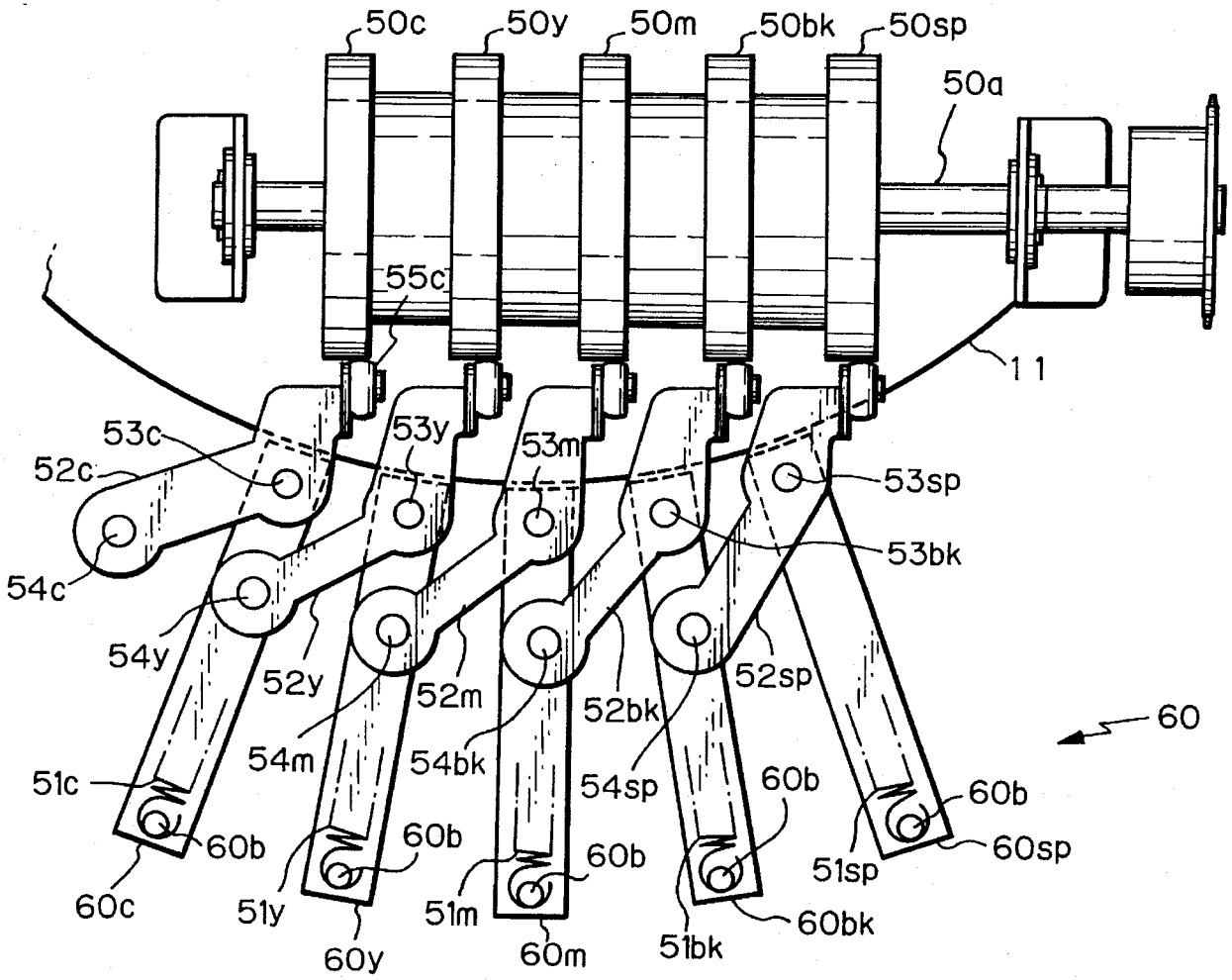
FIG. 5 is a view of a mechanism for selectively elevating heads included in the developing device.

The latent image is transferred from the photoconductive drum 21 to the clamp drum 11, i.e., the paper 71 wrapped therearound. The image on the paper 71 is a mirror image of the image on the photoconductive drum 21. The latent image transferred to the paper 61 is developed by the developing device, i.e., slit type developing heads 60. The heads 60 are each supplied with a developing liquid or developer 10, FIG. 4. Specifically, as shown in FIG. 4, each head 60 is communicated a liquid reservoir 64 via a pump 61, a solenoid-operated valve 62, a liquid feed pipe 65, and a liquid return pipe 66. As shown in FIG. 5, the heads 60 comprise a yellow (y) head 60*y*, a magenta (m) head 60*m*, a cyan (c) head 60*c*, a black (bk) head 60*bk*, and a head 60*sp* for a special color (sp). The heads 60*y*–60*sp* are arranged radially and spaced about 2 millimeters from the clamp drum 11 when they do not effect development. As shown in FIG. 4, at least one groove 60*a* is formed in the surface of each head 60 which faces the clamp drum 11, extending in the axial direction of the clamp drum 11.

As shown in FIG. 5, cams 50*y*, 50*m*, 50*c*, 50*bk* and 50*sp* are identical in configuration and respectively associated with longitudinally opposite ends of the heads 60*y*–60*sp*. The cams 50*y*–50*sp* at each end of the heads 60*y*–60*sp* are mounted on a shaft 50*a*. Such shafts 50*a* are rotated by a motor and chain, not shown, in synchronism with each other. The cams 50*y*–50*sp* are configured such that each of them lifts or lowers respective head 60 every one-tenth rotation. Cam followers 52*y*, 52*m*, 52*c*, 52*bk* and 52*sp* are respectively mounted on the heads 60*y*–60*sp* by shafts 53*y*–53*sp*. The cam followers 52*y*–52*sp* are respectively rotatably mounted on shafts 54*y*–54*sp* at one end thereof; the shafts 54*y*–54*sp* are supported by the printer body. Rollers 55*y*, 55*m*, 55*c*, 55*bk* and 55*sp* are respectively mounted on the other ends of the cam followers 52*y*–52*sp* and held in contact with the cams 50*y*–50*sp*. Springs 51*y*, 51*m*, 51*c*, 51*bk* and 51*sp* are each anchored at one end to respective pin, not shown, studded on the printer body and at the other end to associated one of pins 60*b* studded on the lower ends of the heads 60*y*–60*sp*. In this configuration, the cam followers 52*y*–52*sp* are constantly biased against the associated cams 50*y*–50*sp* together with the heads 60*y*–60*sp*. As a result, the heads 60*y*–60*sp* are movable up and down in association with the rotation of the cams 50*y*–50*sp*, respectively.

Referring again to FIG. 1, in the event of development, the clamp drum 11 is rotated as indicated by the arrow. Assume that the leading edge portion of the drum 71 carrying the latent image has arrived atone of the heads 60 which is to develop the image. Let this head be referred to as an active head 60 hereinafter. Then, the motor, not shown, is energized to rotate the cam shaft 50*a* by one-tenth rotation. As a result, the active head 60 is pressed against the clamp drum 11, i.e., the paper 71 by associated one of the cams 50*y*–50*sp*. As shown in FIG. 4, as the paper 71 substantially hermetically closes the groove 60*a* of the active head 60, the pump 61 develops vacuum in the groove 60*a* with the result that the developing liquid 10 is circulated from the reservoir 64 to the reservoir 64 via the feed pipe 65, head 60, return pipe 66, and pump 61. The active head 60 develops the latent image carried on the paper 71 with the liquid 10.

After the trailing edge of the image portion of the paper 71 has moved away form the active head 60, the solenoid-operated valve 62 stops the supply of the liquid 10, and then the liquid 10 is squeezed out for a predetermined period of time. After the squeezing, the pump 61 is deenergized. Then, the cam shaft 50*a* is rotated by one-tenth rotation to move the active head 60 away from the clamp drum 11. If the squeezing is not complete, the liquid 10 will remain on the trailing edge portion of the paper 71. In such a case, a blotter roller 41, FIG. 1, fully squeezes the paper 71. In addition, a fan 42, FIG. 1, is driven to dry the paper 71 and blotter roller 41. A scorotron charger 43, FIG. 1, dissipates potential remaining on the paper 71 after the development, thereby preventing different colors from being mixed at the next step. After the latent image has been developed by all the heads 60*y*–60*sp*, the clamp drum 11 is driven to a paper discharge position. At this position, the clamp 12 is opened to release the paper 71, and then the eject pin 13 juts out to raise the leading edge of the paper 71. Finally, the paper 71 is discharged onto a table 77.

Referring to FIG. 6, a control system for controlling the color printer will be described. As shown, the control system comprises a printer controller 1, a printer input section 2, a printer output section 3, an operating section 4, and a writing section 5.

Figure 7:
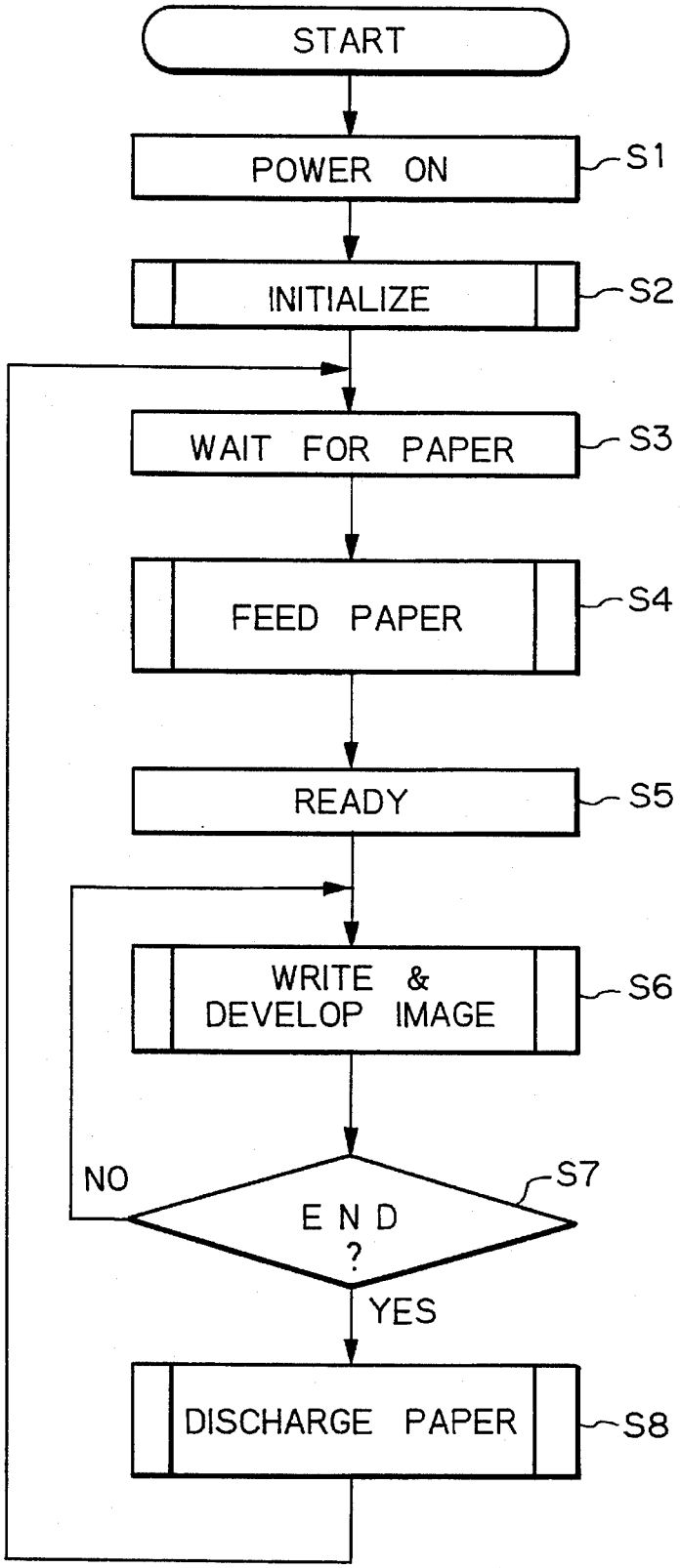
FIG. 7 is a flowchart representative of a specific operation of the control system.

The operation of the printer controller 1 will be described with reference to FIG. 6 and FIG. 7. As shown, when a power switch, not shown, provided on the printer is turned on (step S1), the controller 1 initializes the heads 60, clamp drum 11, and writing section 5 for writing a latent image (step S2). At the step S2, a head home position sensor included in the printer input section 2 senses the home position of the cams 50 of the heads 60. Here, the home position is such that all the heads 60 are lowered, and the head 60 to be raised next is the head which will be used first in an image forming process. Specifically, when the power switch is turned on, the controller 1 determines the current positions of the cams 50 by referencing the output of the home position sensor. If the cams 50 are not in their home position, the controller 1 energizes the head motor to move them to the home position via the cam shaft 50*a*.

After the initialization of the heads 60, the controller 1 initializes the clamp drum 11. In FIG. 6, a drum home position sensor is responsive to a particular portion provided on the clamp drum 11. The drum motor is energized to drive the clamp drum 11 until the drum home position sensor senses the above-mentioned portion of the drum 11. As a result, the controller 1 confirms that it can recognize the angular position of the clamp drum 11. Thereafter, the motor associated with the polygon mirror 31 is turned on to rotate the mirror 31 until the rotation thereof becomes stable. Then, a power supply for the laser diode driver is turned on.

When the clamp drum 11 in rotation arrives at a predetermined position, a paper feed solenoid is turned on. As a result, the clamp portion of the drum 11 is brought to the top with the clamp 12 being sequentially opened. Then, the rotation of the clamp drum 11 is stopped, and the printer is held in a stand-by position (step S3). In this condition, the paper 71 is gripped by the clamp drum 11. When the operator presses a predetermined switch provided on the operating section 4, the operation for wrapping the paper 71 on the drum 11 begins. Subsequently, the paper 71 is cut from the roll 70, and the paper feed operation ends (step S4). The clamp drum 11 carrying the paper 71 thereon is brought to a stop at a ready position and awaits the start of an image writing procedure (step S5).

As the operator presses another particular switch on the operating section 4, the operation for writing a latent image and developing it begins (step S6). Specifically, as shown in FIG. 1, the clamp drum 11 starts rotating while a discharge LED (Light-Emitting Diode) 24, power supply for a charger 23 and so forth are turned on. As a sensor responsive to a write start position senses a predetermined portion of the clamp drum 11, it sends the resulting output thereof to the controller 1. In response, the controller 1 sends a write start signal to the writing section 5 to cause it to start forming a latent image on the photoconductive drum 21. At the same time, a power supply for transferring the latent image from the drum 21 to the paper 71 on the drum 11 is turned on. After the latent image has been entirely formed on the drum 21 and then transferred to the paper 71, the power supply for the charger 23 and the power supply for image transfer are turned off.

At the time when the procedure for forming the latent image has completed, the leading end of the latent image is about to reach the photoconductive drum 21. As the clamp 21 is continuously rotated, the clamp portion of the drum 21 is moved to the heads 60*y*–60*sp*. When one of the heads 60*y*–60*sp* to be used, i.e., the active head 60 is aligned with a head elevation position of the paper 71 intervening between the clamp portion and the leading edge of the latent image, the motor associated with the cam shaft 50*a* is turned on to elevate the active head 60. At this instant, the drum 11 may be temporarily stopped to await the rise of the active head 60, or the active head 60 may be raised without the drum 11 stopped. This depends on whether or not a sufficient distance can be provided between the clamp portion of the paper 71 and the leading edge of the image; if such a distance is available, it is not necessary to stop the rotation of the drum 11.

When the active head 60 is fully raised, the head motor driving the cam shaft 50*a* is deenergized, and the clamp drum 11 is rotated. Then, the pump 61 and valve 62 associated with the active head 60 are turned on with the result that the developing liquid 10 is circulated through the active head 60 to develop the latent image. On the start of development, the fan 42 is turned on. When the clamp portion of the paper 71 arrives at the scorotron charger 43, a power source for the charger 43 is turned on to dissipate the charge of the paper 71. When the development completes, the valve 62 is turned off to collect the liquid 10, and then the pump 61 is turned off. Subsequently, the active head 60 is lowered. As soon as the clamp portion of the paper 71 again arrives at the scorotron charger 43, the paper discharge power source and fan 42 are turned off.

After the latent image has been written and then developed in the first color, another latent image corresponding to the next color is written and then developed. After such a procedure has been repeated a predetermined number of times, the paper 71 begins to be discharged (step S7). Specifically, as the clamp portion moves away from the top of the clamp drum 11, the controller 1 turns on a discharge solenoid and opens the clamp 12 at the discharge position, while causing the drum 11 to continuously rotate (step S8). Thereafter, the drum 11 is brought to a stop at the paper feed position, as after the initialization.

The rotation speed of the clamp drum 11 is limited by the process conditions in the event when a latent image is written and when it is developed. However, the drum 11 can be rotated at any desired speed when a latent image is not written or developed. Therefore, to reduce the printing time, the drum 11 should preferably be rotated at a high speed when a latent image is not written or developed. Further, if the drum 11 can be rotated at the same speed during the writing and the development of a latent image, writing and development may be effected at the same time to further reduce the printing time. In this case, the rotation of the drum 11 will not be stopped when the active head 60 is raised, thereby causing a latent image to be written and developed during a single rotation of the drum 11.

Figure 2:
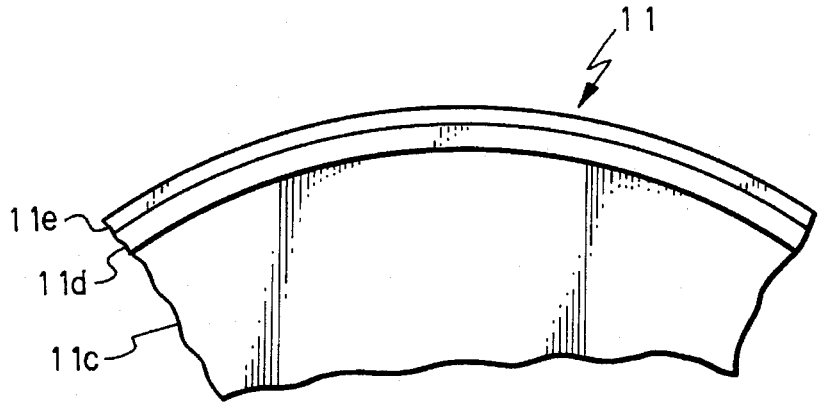
FIG. 2 is a fragmentary section of a clamp drum included in the embodiment.

The problem with the above-described color printer is that when the paper 71 or the photoconductive drum 21 has local defects, e.g., short voltage resistivity the potential for latent image transfer is apt to decrease. This would cause defective transfer to extend even to the area other than the local defects. To eliminate this problem, the illustrative embodiments provides the clamp drum 11 with a structure shown in FIG. 2. As shown, the drum 11 has a cylinder or base 11*c* made of aluminum, a conductive rubber layer 11*d* covering the cylinder 11*c*, and an overcoat layer 11*e* covering the rubber layer 11*d*. The rubber layer 11*d* has a low resistance while the overcoat layer 11*e* has a higher resistance than the rubber layer 11*d* and is resistive to solvents. The rubber layer 11*d* is made of conductive rubber having a hardness of 50 degrees and a resistance of substantially $10^9$ Ωcm, mainly taking account of conductivity and elasticity. Regarding the overcoat layer 11*e*, a suitable material is selected which implements the voltage resisting function in the event of latent image transfer, the transferring function using charging, and when a liquid development is used as in the embodiment, implements resistivity to solvents, promotes easy cleaning by the blotter roller 41, and has a small coefficient of friction when a part thereof where the paper 71 is absent contacts the heads 60. Since the overcoat layer 11*e* has multiple functions as mentioned, it may be made up of a plurality of consecutive layers, if desired.

Further, in the event of image transfer, the embodiment connects the conductive rubber layer 11*d* of the drum 11 to ground and applies a bias voltage between the drum 11 and the photoconductive drum 21 from a bias power source or bias voltage applying means, not shown. This makes it needless for the drive portion of the drum 11 to be made of an insulating material. It is to be noted that the drum 21 is smaller in diameter than the drum 11 and is sparingly susceptible to changes in the axis of rotation. For this reason, the shaft of the drum 21 is made of an insulating material, and the bias voltage is applied to a photoconductor forming the surface of the drum 21.

Moreover, to rotate the drums 11 and 21 at the same speed at their contacting portion in the event of image transfer, the embodiment maintains the drums 11 and 21 pressed against each other by a predetermined force, e.g., 0.1 kg/cm to 0.2 kg/cm. In this condition, the drum 21 is rotated, following the rotation of the drum 11.

Figure 3:
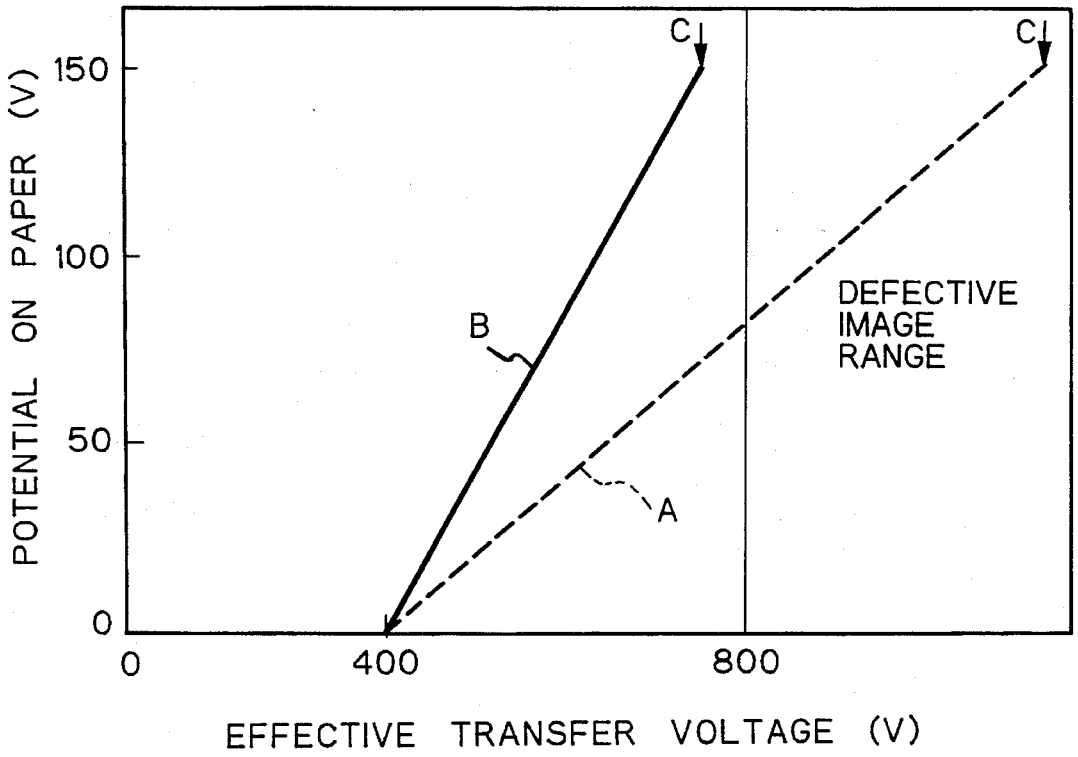
FIG. 3 is a graph showing a relation between the effective transfer voltage and the recording potential deposited on a paper.

FIG. 3 is a graph comparing the photoconductive drum 21 of the embodiment (line B) with a conventional photoconductive drum (line A) with respect to a relation between the effective transfer voltage and the recording potential deposited on the paper 71 in the event of image transfer. The charge potential deposited on the drum is maximum at points indicated by arrows C, while a defective image containing white dots occurs in the right portion of the graph. The drum 21 of the embodiment and the conventional drum differ from each other in respect of the image transfer condition for depositing a sufficient and same potential on the paper 71. Specifically, as the line A of FIG. 3 indicates, the conventional drum cannot allow a sufficient potential to deposition the paper 71 without resorting to an effective transfer voltage higher than 800 V, which lies in the defective image range. In light of this, the embodiment provides the drum 21 with a greater electrostatic capacity to prevent the effective transfer voltage from increasing. The greater electrostatic capacity is obtainable if, for example, a CTL layer included in the drum 21 is reduced in thickness. Since a bias voltage of about 400 V is necessary for image transfer, the embodiment selects an electrostatic capacity which maintains the charge potential of the drum 21 lower than 800 V. If desired, the material of the drum 21 or the configuration of any other part may be changed to provide the drum 21 with such an electrostatic capacity.

As stated above, in the illustrative embodiment, the clamp drum 11 is made up of the aluminum cylinder 11*c*, conductive rubber layer 11*d*, and overcoat layer 11*e*. This prevents the bias voltage for image transfer from lowering due to the local defects of the paper 71 and photoconductor or locally suppresses the fall of the bias voltage. As a result, the image density is prevented from locally decreasing, and the local fall of the bias voltage is prevented from extending to lower the entire image density. The embodiment, therefore, ensures attractive images free from irregular density distributions. Incidentally, when the resistance of the overcoat layer 11*e* of the drum is excessively high, the image density decreases or changes; when it is excessively low, there occurs a defective image, e.g., an image partly lost in a stripe form extending perpendicularly to the moving direction of the paper 71. Experiments showed that the overcoat layer 11*e* having the previously mentioned resistance eliminates the above occurrences.

The bias voltage for image transfer is applied while the conductive rubber layer 11*d* is connected to ground. This makes it needless to implement the base of the drum 11 by an insulating material which is difficult to machine with accuracy and extremely susceptible to wear and changes in ambient temperature and humidity. It follows that precision drive and, therefore, high definition hard-dot images are achievable.

In the event of image transfer, the drums 21 and 11 are pressed against each other by a predetermined force, and the drum 21 follows the rotation of the drum 11. Therefore, the drums 21 and 11 are rotated at the same speed at their contacting portion, so that the drum 21 is driven without irregularity. In addition, since the drive does not include any gear, gear marks ascribable to backlash is eliminated. This prevents the displacements of dots from accumulating and, therefore, ensures images desirably balanced in lines and colors. For experiment, the force pressing the drums 21 and 11 against each other was selected to be 0.1 kg/cm to 0.2 kg/cm, as in the embodiment. Then, the nip width of the drums 21 and 11 was measured to range from 3 mm to 4 mm, while the charging condition was calculated to be more than 95% based on time constant when the drums 21 and 11 were pressed against each other for image transfer. The resulting latent images were found stable in potential.

The photoconductive drum 21 is provided with a great electrostatic capacity, as stated earlier. This maintains the charge potential of the photoconductor lower than 400 V and maintains, as indicated by the line B in FIG. 3, the effective transfer voltage lower than 800 V. The embodiment, therefore, eliminates abnormal discharges at the time of image transfer to thereby ensure high quality images whose solid portions are free from undesirable white dots. In addition, a required recording potential is surely deposited on the paper 71.

In summary, it will be seen that the present invention provides an image forming apparatus having various unprecedented advantages, as enumerated below.

(1) A bias voltage for image transfer is prevented from lowering due to the local defects of a paper and photoconductor or has the fall locally suppressed. As a result, the image density is prevented from locally decreasing, and the local fall of the bias voltage is prevented from extending to lower the entire image density. This ensures attractive images free from irregular density distributions.

(2) A base included in a medium conveying member does not have to be made of an insulating material which is difficult to machine with accuracy and extremely susceptible to wear and changes in ambient temperature and humidity. It follows that precision drive and, therefore, high definition hard-dot images are achievable.

(3) In the event of latent image transfer, an image carrier is rotated following the rotation of the medium conveying Hence, the image carrier and medium conveying member are rotated at the same speed at their contacting portion, so that the image carrier is driven without irregularity. In addition, since the drive does not include any gear, gear marks ascribable to backlash is eliminated. This prevents the displacements of dots from accumulating and, therefore, ensures images are desirably balanced in lines and colors.

(4) The image carrier, for example, is configured such that an effective transfer voltage remains lower than 800 V. This eliminates abnormal discharges at the time of image transfer to thereby ensure high quality images whose solid portions are free from undesirable white dots.

Various modifications will become possible for those skilled in the art after receiving the teachings of the present disclosure without departing from the scope thereof. For example, while the embodiment has been shown and described in relation to a color printer having a plurality of heads 60*y*–60*sp*, the present invention is similarly applicable to any other type of printer, e.g., a printer having a single head and transferring a plurality of latent images to the paper 71 one above the other. The developing liquid 10 may, of course, be replaced with a powdery toner conventionally used with a copier or similar equipment. Further, the present invention is practicable even with one or more of the various constructions described above: a construction wherein the clamp drum 11 is made up of the consecutive layers 11*c*, 11*d* and 11*d*, and a bias voltage is applied with the layer 11*d* connected to ground; a construction wherein the drums 21 and 11 are pressed against each other by a predetermined force, and the drum 21 follows the rotation of the drum 11; and a construction wherein the drum 21 is so configured as to prevent the effective transfer voltage from increasing.

What is claimed is:

1. An image forming apparatus comprising:

an image carrier in the form of a drum for forming a latent image on a surface thereof;

medium conveying means in the form of a cylinder for releasably clamping and conveying a recording medium;

grounding means for connecting said medium conveying means to ground;

bias voltage applying means for applying a bias voltage to said image carrier for transferring the latent image to the recording medium; and wherein, said grounding means prevents local defects in the recording medium from lowering the bias voltage.

2. An image forming apparatus according to claim 1, further comprising:

a base of said medium conveying means;

a layer covering said base and formed of an elastic substance;

said medium conveying means transfers latent image from said image carrier to said recording medium electrostatically; and said image carrier and said medium conveying means being pressed against each other by a predetermined force, whereby a drive force is transferred from said medium conveying means to said image carrier so that said image carrier is frictionally rotated as said medium conveying means rotates.

3. An apparatus as claimed in claim 1, further comprising:

developing means for selectively transferring a developing material to the recording medium where the latent image exists after the latent image is transferred from the image carrier to the recording medium.

4. An image forming apparatus comprising:

an image carrier in the form of a drum for forming a latent image on a surface thereof;

medium conveying means in the form of a cylinder for releasably clamping and conveying a recording medium;

grounding means for connecting said medium conveying means to ground;

bias voltage applying means for applying a bias voltage to said image carrier;

wherein an effective transfer voltage is produced by adding a charge potential of said image carrier and said bias voltage;

wherein, said transfer voltage is lower than 800 V; and wherein a charge potential of said drum is lower than 400 V.

5. An image forming apparatus comprising:

an image carrier in the form of a drum for forming a latent image on a surface thereof;

medium conveying means in the form of a cylinder for releasably clamping and conveying a recording medium;

grounding means for connecting said medium conveying means to ground; and bias voltage applying means for applying a bias voltage to said carrier for transferring the latent image to the recording medium.

* * * * *